US005611403A

United States Patent [19]

Theurer et al.

[11] Patent Number: 5,611,403

[45] Date of Patent: Mar. 18, 1997

[54] MACHINE FOR SUCKING UP RAIL BALLAST

[75] Inventors: Josef Theurer, Vienna; Friedrich Oellerer, Linz; Herbert Wörgötter, Gallneukirchen, all of Austria

[73] Assignee: Franz Plasser Bahnbaumaschinen-Industriegesellschaft M.B.H., Vienna, Austria

[21] Appl. No.: 313,211

[22] PCT Filed: Jan. 5, 1994

[86] PCT No.: PCT/AT94/00001

§ 371 Date: Oct. 20, 1994

§ 102(e) Date: Oct. 20, 1994

[87] PCT Pub. No.: WO94/17245

PCT Pub. Date: Aug. 4, 1994

[30] Foreign Application Priority Data

Jan. 29, 1993 [AT] Austria ..... 152/93

[51] Int. Cl.[6] ..... E01B 27/00

[52] U.S. Cl. ..... 171/16; 37/104; 104/2

[58] Field of Search ..... 37/104, 105; 104/2, 104/279; 171/16; 15/340.1, 348; 414/528, 502, 503, 505, 523

[56] References Cited

U.S. PATENT DOCUMENTS

| | | | |
|---|---|---|---|
| 3,967,395 | 7/1976 | Stewart | 171/16 X |
| 4,342,165 | 8/1982 | Theurer et al. | 37/104 |
| 4,479,439 | 10/1984 | Theurer et al. | 104/2 X |
| 4,614,238 | 9/1986 | Theurer et al. | 104/2 X |
| 4,741,072 | 5/1988 | Wilkerson . | |
| 5,090,483 | 2/1992 | Theurer et al. | 171/16 |
| 5,090,484 | 2/1992 | Theurer et al. | 104/2 X |
| 5,257,580 | 11/1993 | Theurer et al. | 171/16 X |
| 5,271,166 | 12/1993 | Theurer et al. | 171/16 X |
| 5,452,528 | 9/1995 | Theurer et al. | 37/104 |

FOREIGN PATENT DOCUMENTS

| | | |
|---|---|---|
| 384446 | 11/1987 | Austria . |
| 2655669 | 6/1991 | France . |
| 2226612 | 1/1973 | Germany . |
| 2136306 | 1/1973 | Germany . |
| 8236650 | 6/1983 | Germany . |
| 9111238.9 | 1/1992 | Germany . |

*Primary Examiner*—Terry Lee Melius
*Assistant Examiner*—Victor Batson
*Attorney, Agent, or Firm*—Collard & Roe, P.C.

[57] ABSTRACT

A suction unit (76) provided with a suction pipe (80) having a suction opening (81) for sucking off crushed rock and being vertically and laterally adjustable is allocated to a machine (57) for treating the ballast bed of a track (60) with a machine frame (58) supported on rail travelling undercarriges (59). In addition, there is provided a clearing apparatus (62) disposed at a distance from the suction opening (81) in the longitudinal direction of the machine and provided with an endless clearing chain (64) rotatable by a drive (63) for removing the crushed rock disposed below the track (60). Like the suction pipe (80), it is provided with separate drives (82, 99) for vertical and lateral adjustment independently from one another.

11 Claims, 3 Drawing Sheets

MACHINE FOR SUCKING UP RAIL BALLAST

The invention relates to a machine for treating the ballast bed of a track, which comprises a machine frame means supported on undercarriages, which frame is provided with a suction unit with a suction pipe having a suction opening for sucking off crushed rock and being vertically and laterally adjustable.

Such a suction machine is known from DE 82 36 650 U. This machine is provided with a suction pipe projecting beyond the machine frame, with which crushed rock is sucked off from the track and guided to a collecting container. The crushed rock is cleaned with the help of a vibratory screen and is thrown back on to the track with the help of a transverse conveyor belt.

A further such suction machine is known from DE 21 36 306 A. The suction nozzle attached to the projecting suction pipe is provided with vibrators for loosening the crushed rock to be sucked off. The suction pipe is supported by a rotatable and swivellable carrier frame above the driver's cabin.

From AT 384 446 B a suction machine is known which is provided with a suction arrangement formed by three suction nozzles adjacently arranged in the transverse direction of the machine. At the lower end of each suction pipe, which is provided with a suction opening, there is disposed a rotating clearing member so as to loosen up encrusted rock immediately prior to the suction.

A further machine known from DE 22 26 612 A for treating a ballast bed of a track is provided with two clearing apparatuses each attached on a longitudinal side of a machine frame, which apparatuses are formed as clearing beams with a rotating endless clearing chain. Said clearing beams are rotatable about a vertical pivot axle provided at their one longitudinal end and vertically adjustable and are pivoted upwardly about a horizontal axis extending in the transverse direction of the machine when being taken out of operation.

For removing the crushed rock, the clearing apparatuses are lowered to the ballast bed shoulders and thereafter swivelled in from both sides below the track grid, with crushed rock situated below the track grid being conveyed towards the track shoulders and supplied to a screening unit for cleaning by an upwardly inclined conveyor arrangement.

It is the object of the present invention to provide a machine of the kind mentioned above which allows the complete removal of the crushed rock both for small as well as large areas of the ballast bed of a track.

This object is achieved with a machine of the kind mentioned above by providing a clearing apparatus which is arranged at a distance from the suction opening of a suction pipe in the longitudinal direction of the machine and is provided with an endless clearing chain rotatable by a drive for removing the crushed rock disposed below the track, the clearing apparatus and the suction pipe being provided with separate drives for lateral and vertical adjustment independently from one another.

With this combination of features two different systems for removing crushed rock are available for achieving improved work results in connection with the highest possible removal of crushed rock even at narrow places in an advantageous manner, usable either jointly or separately. Favourably, the substantially larger part of the ballast bed of the track situated below the track grid is transportable by the more powerful mechanical clearing apparatus in the transverse direction of the machine towards the shoulder of the ballast bed, whereas the suction pipe with the smaller cross section is immersible in an unimpeded manner and, parallel to the clearing apparatus, at narrow positions which cannot be reached by the clearing chain. The crushed rock collected in the ballast bed shoulder area with the help of the clearing chains can optionally, depending on the various operational conditions, either be sucked off or be conveyed off by a mechanical system. In the event that the collection of crushed rock is situated between a platform and the track grid, for example, only suction is possible, as owing to the narrow gap there is not enough space for mechanical conveyance. The machine in accordance with the invention also provides the possibility to commence the crushed-rock movement by a powerful mechanical system in the transvere direction of the machine and to finally end it with a suction at a place more suitable for the suction system laterally outside of the track grid. In a particularly preferable manner the combination in accordance with the invention provides the possibility to facilitate the commencement of the clearing chain operation by making a ditch in a layer of crushed rock with the help of the suction pipe so that the chain may be lowered to the operating position.

According to one embodiment, the clearing apparatus comprises a clearing beam extending into the ballast bed perpendicularly to the longitudinal direction in an operating position, and two pulleys are mounted on the clearing beam, the clearing chain being trained about the pulleys for revolving in a horizontal plane extending substantially parallel to the track. One of the pulleys may be located adjacent an end of a respective one of the sleepers in the operating position, and the suction pipe has attached thereto a suction hose having a suction opening adjacent the one pulley. This allows a particularly advantageous division of the crushed rock movement into a first section disposed below the track grid and a suction section disposed adjacent thereto. This combination leads to the advantage that a repeated immersion of the suction opening for removing the crushed rock in the sleeper cribs is no longer necessary, a process which is time-consuming and leads to unsatisfactory results.

According to a further embodiment of the invention, the machine frame means comprises a first machine frame having opposite ends and a second machine frame having opposite ends, the first machine frame supporting the suction unit, a carrier frame for the suction pipe, the suction pipe projecting beyond one of the first machine frame ends, and a conveyor belt unit at the opposite first machine frame end, and the second machine frame supporting the clearing apparatus, an operator's cab within view of the clearing apparatus, and another conveyor belt unit extending in the longitudinal direction and leading to one of the second machine frame ends, and further comprising a coupling connecting the one first machine frame end with an end of the second machine frame opposite the one end thereof. The suction pipe may have attached thereto a suction hose having a suction opening and an end opposite the suction opening, and the machine further comprising a coupling at the first machine frame end for detachably connecting the opposite suction hose end to the suction pipe. Also, a coupling may detachably connect a pipe section defining the suction opening with the suction pipe. This enables the best possible adaptation to different conditions during operation, with the suction pipe also being usable for sucking off the crushed rock collected by the clearing apparatuses at the side next to the track.

In accordance with yet another embodiment, the machine frame means comprises a first and a second machine frame part, the machine frame parts being connected by an articulated joint and one of the undercarriages supporting the articulated joint on the track, the first machine frame part supporting the suction unit and a first conveyor belt unit extending partially below the suction units in the longitudinal direction to a discharge end projecting beyond an end of the first machine frame part opposite the articulated joint, and the second machine frame part supporting a vertically and laterally adjustable carrier frame for a suction pipe section defining the suction opening, the clearing apparatus and a second conveyor belt units extending to an end of the second machine frame part opposite the articulated joint. Such a machine which is more simplified with respect to its constructional arrangement, with an unimpaired view being possible from the single worker's cabin on to the clearing apparatus and the suction pipe.

A particularly effective conveyance of crushed rock in connection with a simultaneous cleaning of crushed rock may be obtained with a clearing chain which comprises a transverse course extending horizontally and perpendicularly to the longitudinal direction and two upwardly inclined longitudinal courses connected to the transverse course, the chain encompassing the track in an operating position wherein the horizontally extending course is situated below the track in the ballast bed, and a screening installation arranged to receive crushed rocks excavated by the revolving chain and to clean the crushed rocks.

The invention shall now be outlined in greater detail by reference to the embodiments shown in the drawings, in which.

Figure 1:
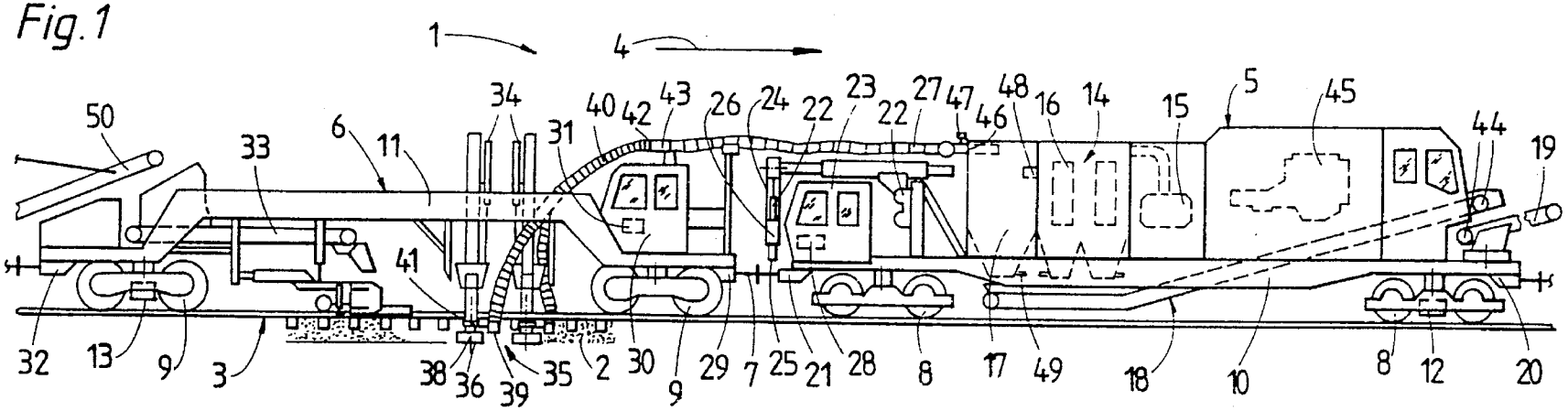
FIG. 1 shows a side view of a machine for treating the ballast bed of a track.
Figure 2:
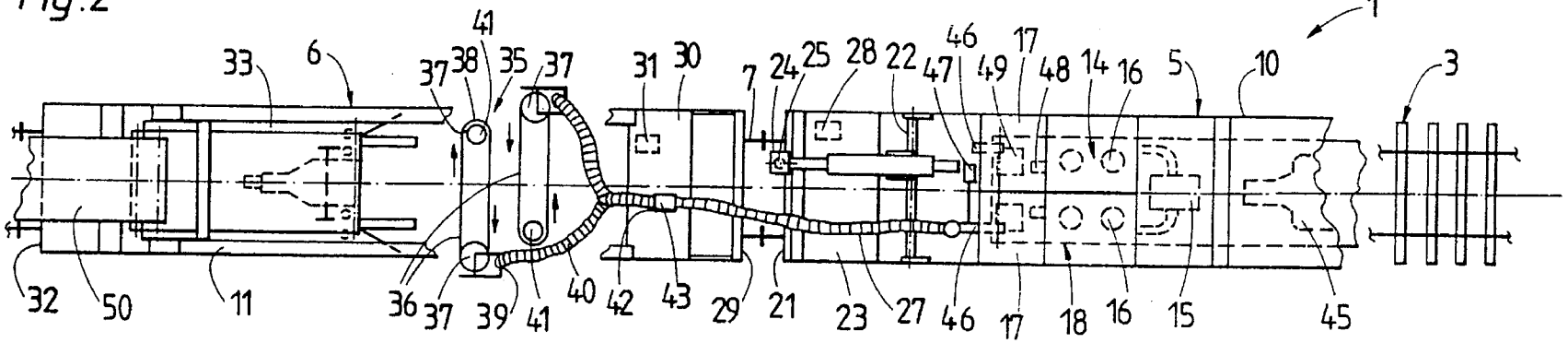
FIG. 2 shows a partly schematic top view of the said machine.

A machine 1, shown in FIGS. 1 and 2, for treating the ballast bed 2 of a track 3 comprises a first machine unit 5 which is situated forward in the working direction (represented by arrow 4) and a second rear machine unit 6. Machine units 5, 6 are connected by a coupling 7 and comprises a machine frame 10, 11 supported on undercarriages 8, 9 and are movable by drives 12, 13.

A suction unit 14 on the machine frame 10 of the first machine unit 5 comprises a vacuum generator 15, a filtering chamber 16 and a crushed rock storage means 17. It is provided, as is filter chamber 16, in its lower end zone with discharge flaps 49 which are closable by remote control. Below it there is provided the rear end of a conveyor belt unit 18 extending in the longitudinal direction of the machine and being provided with drives 44. The front end of said belt projects over a front machine end 20, forming a discharge 19. On a rear machine end 21 opposite of the discharge 19 there is disposed a carrier frame 24 which is laterally and vertically adjustable by drives 22 and projects over a driver's cabin 23. Said carrier frame 24 is connected at its lower end to tubular suction opening 25 which is provided with a coupling 26 bar detachable connection to a flexible tubular suction pipe 27. The drives 22 of the carrier frame 24 are controllable by a control device 28 situated in the driver's cabin 23. A power-supply unit 45 is provided for supplying machine 1 with power.

The machine frame 11, which is upwardly recessed, of the second machine unit 6 is provided at front machine end 29 with an operator's cabin 30 with a central control unit 31 and at rear machine end 32 with a receiving end of a conveyor belt unit 33 extending in the longitudinal direction of the machine. Between the two undercarriages 9 there is provided a clearing apparatus 35 which is laterally and vertically adjustable by drives 34. Said clearing apparatus 35 is composed of two clearing beams 36 which are slightly spaced from one another in the longitudinal direction of the machine and extend during operation horizontal and perpendicular to the longitudinal direction of the machine and below the track 3 and which are provided with pulleys 37 (see FIG. 2) disposed at the longitudinal ends. An endless clearing chain 38 guided around pulleys 37 is thus arranged for rotation in a horizontal plane parallel to the track plane.

A suction opening 39 of a flexible suction tube 40 is associated with the outer pulley 37 with respect to the transverse direction of the machine situated during operation in the sleeper end zone. Each clearing chain 38 can be made to rotate by its own drive 41. An end 42 of the suction tube 40 distanced from the suction opening 39 is provided with a coupling 43 for a detachable connection with the suction pipe 27 of the first machine unit 5. Said coupling 43 is arranged above the working cabin 30 which is situated at the end of machine unit 6.

As is shown in FIG. 2, two storage means 17 for the crushed rock and filter chambers 16 are arranged adjacent each other in the transverse direction of the machine. Each storage means 17 and each filter chamber 16 is provided with an own suction opening 46. Suction pipe 27 is displaceable in the transverse direction of the machine with the help of a drive 47 from one to the opposite suction opening 46 of the two storage means 17. Drive 47 is controlled by a filling level indicator 48 as soon as the crushed rock sucked into the storage means 17 has reached a certain filling level. Owing to the activation of drive 47, the end of suction pipe 27 is displaced towards the opposite suction opening 46 of the empty storage means 17. During the suction and the intake of crushed rock in the empty storage means 17, the other filled storage means 17 can be unloaded onto the conveyor belt unit 18 by opening the discharge flap 49.

The carrier frame 24 is displaceable in the longitudinal and transverse directions of the machine by the drives 22, with the vertical part which is connected to the suction opening 25 being additionally held in a swivellable manner about a vertical axis.

Hereinafter the function of machine 1 will be explained in closer detail. At the beginning of the operation of machine 1, the rear end of suction pipe 27 is connected to suction opening 25 and, by controlling drives 22, crushed rock for forming a ditch in the layer of crushed rock is sucked off from the ballast bed 2 of the track 3. This ditch in the layer is used to enable the lowering of the two clearing beams 36 of the clearing apparatus 35 below the track grid in an unimpeded manner. After their lowering by controlling drives 34, the suction pipe 27 is detached from suction opening 25 and connected to suction tube 40 with the help of coupling 43. Thereafter, the machine 1 is moved continuously in the working direction as indicated by arrow 4 whilst controlling the vacuum generator 15 for producing a pressure below atmospheric and activiating the drives 41. In this way, the two rotating clearing chains 38 cause an uninterrupted transfer of the crushed rock situated below the track grid in the direction towards the two sleeper end zones. A continuous suction of the collected crushed rock is carried out there by means of the two suction tubes 40. The crushed rock that is sucked in is stored in one of the two storage means 17 (as was already mentioned above) and deposited on storage cars (not shown) preceding the machine by means of the conveyor belt unit 18.

Parallel to this, a continuous supply of new crushed rock is bed from at least one storage carriage 50 following the machine, which crushed rock is discharged by conveyor belt unit 33 onto an excavated subgrade under track 3. If, for example, a track section should be reached during the continuous work advancement where crushed rock is to be sucked off outside of the working zone of clearing apparatus 35, suction pipe 27 is again connected to suction opening 25. Owing to the relatively wide adjustment range of carrier frame 24 it is possible to easily suck off crushed rock from sections of the ballast bed 2 adjacent the sleeper end zone.

The two machine units 5, 6 are separable at any time through coupling 7, so that optionally the first machine unit 5 can be used alone for sucking off crushed rock. It is understood that it is also possible to provide the suction pipe 27 with a branch so that, on the one hand, the suction opening 25 and, on the other hand, the suction tube(s) 40 are connected permanently to the suction unit 14. In this case it would only be necessary to provide a control flap so as to deflect the suction flow, as desired, onto the suction tubes 40 or the suction opening 25.

Figure 3:
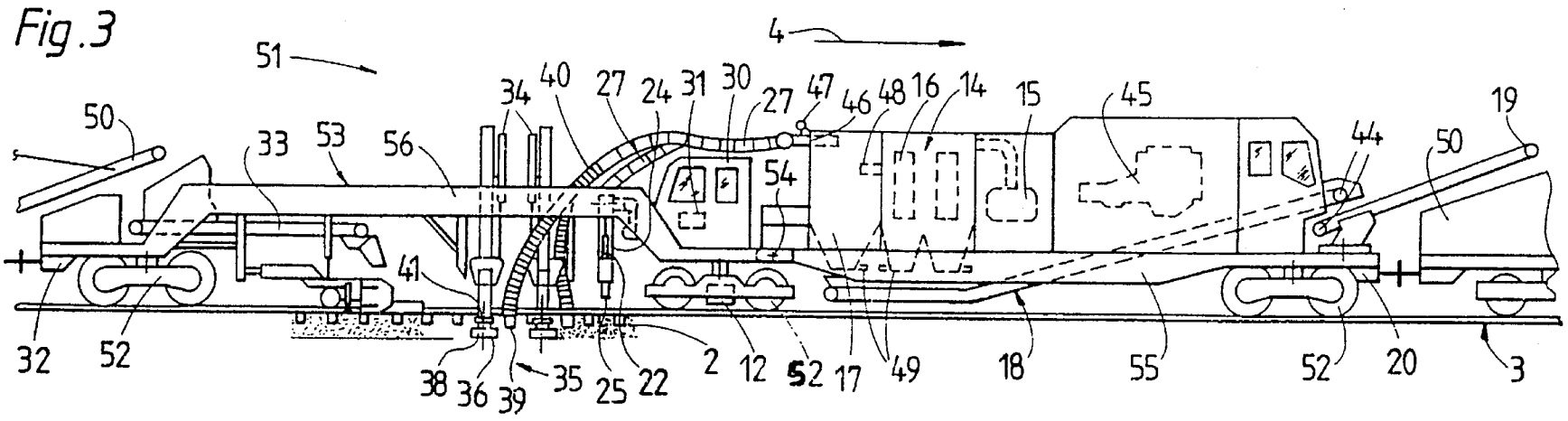
FIG. 3 shows a side view of a modification of a machine formed by two frame parts which are connected in an articulated manner.

The machine 51 as shown in FIG. 3 consists of a machine frame 53 supported on undercarriages 52 and consisting of a first and second frame part 55, 56 pivoted to each other by articulated joint 54 supported on the track by a further undercarriage 52. In contrast to machine 1 described in FIGS. 1 and 2, the carrier frame 24 for the suction pipe 27 is arranged directly in front of the clearing apparatus 35 on the second frame part 56 which is at the rear in the working direction. Both the carrier frame 24 with the suction opening 25 as well as the clearing apparatus 35 are controllable by the control device 31. With respect to the other parts, reference is hereby made for the sake of simplicity to the description in FIGS. 1 and 2.

Figure 4:
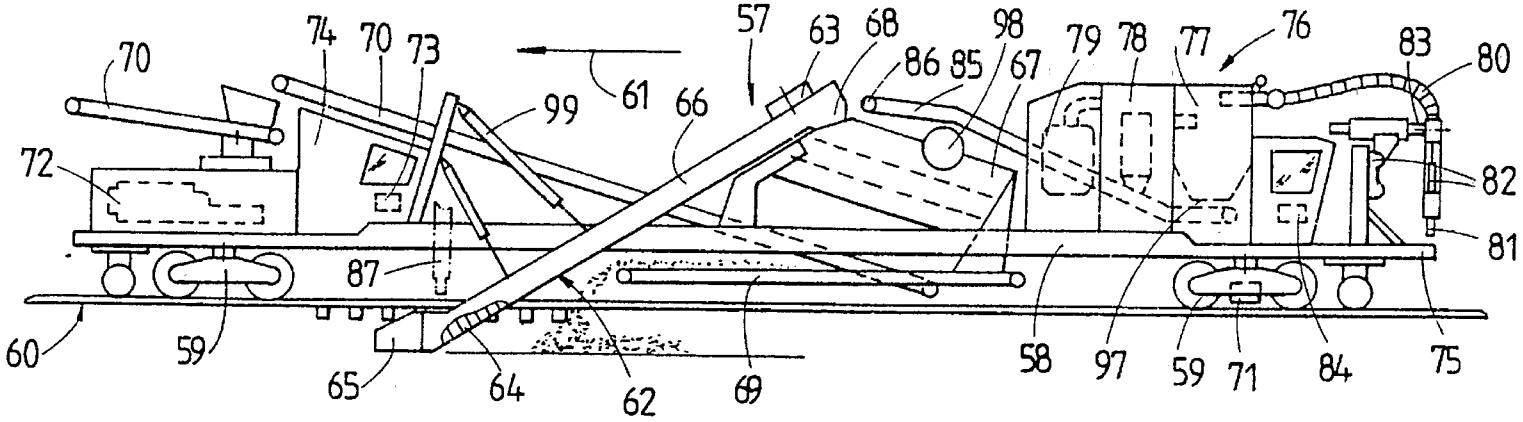
FIGS. 4, 5 and 6 show another embodiment arranged as a combined cleaning and sucking machine.

The track maintenance machine shown in FIG. 4 is a ballast cleaning machine 57 provided with a machine frame 58 which is supported by undercarriages 59 on a track 60 consisting of rails and sleepers. Cleaning machine 57 is shown in the working position, in which it moves forward in the direction of arrow 61 and in which a clearing apparatus 62 with an endless clearing chain 64 which can be made to rotate around track 60 by a drive 63 to excavate the track ballast to be cleaned. The clearing apparatus 62, which is vertically and laterally adjustable by drives 99, consists of a transverse chain member 65 extending perpendicularly to the longitudinal direction of the machine and horizontally and two longitudinal guiding tracks 66 connected thereto. These form a joint discharge 68 above a screening system 67 which is vibratable by a drive 98. For returning the track ballast which has been cleaned by screening system 67 to track 60, a conveyor belt 69 has been provided. The detritus formed during the cleaning in the screening system 67, can be conveyed via conveyor belts 70 for loading onto freight cars or for depositing at the side of the track. A power supply unit 72 has been provided for supplying a drive 71 and all other drives with energy. The control of clearing apparatus 62 is made from a central control unit 73 which is situated in the operators cabin 74.

On a rear machine end 75 there is disposed a suction unit 76 which is composed of a storage means 77 for crushed rock, a filter chamber 78 and a vacuum generator 79. A suction pipe 80 projecting beyond the rear machine end 75 and having a suction opening is connected to storage means 77. This suction pipe 80 rests on a carrier frame 83 which is vertically and laterally adjustable by drives 82. The suction unit 76 and the drives 82 are controllable by a control unit 84 situated in the driver's cabin. A conveyor belt 85 extending in the longitudinal direction of the machine is provided below the suction unit 76, the discharge end 86 of said belt 85 disposed at a higher level being positioned above the screening system 67. As is indicated by the dot-dash lines 87, suction pipe 80 may be arranged alternatively in the zone of the transverse chain member 65 of clearing apparatus 62. In this arrangement it would be possible to control suction pipe 80 from the operator's cabin 74.

During the operation of cleaning machine 57, the suction pipe 80 can be used either parallel to or alternatively to clearing apparatus 62. The introduction of the transverse chain member 65 is facilitated prior to the operation of clearing apparatus 62 by forming the ditch required for introducing the transverse chain member 65 below track 60 by a suction of the crushed rock with the help of suction pipe 80. Suction pipe 80 can obviously also be used in all those areas where the use of clearing apparatus 62 is not possible for reasons of lack of space such as in the area of platform edges, for example. The crushed rock that is sucked in and stored in the storage means 77 is discharge through discharge openings 97 onto the conveyor belt 85 disposed below and conveyed by it to screening system 67 for cleaning.

Figure 5:
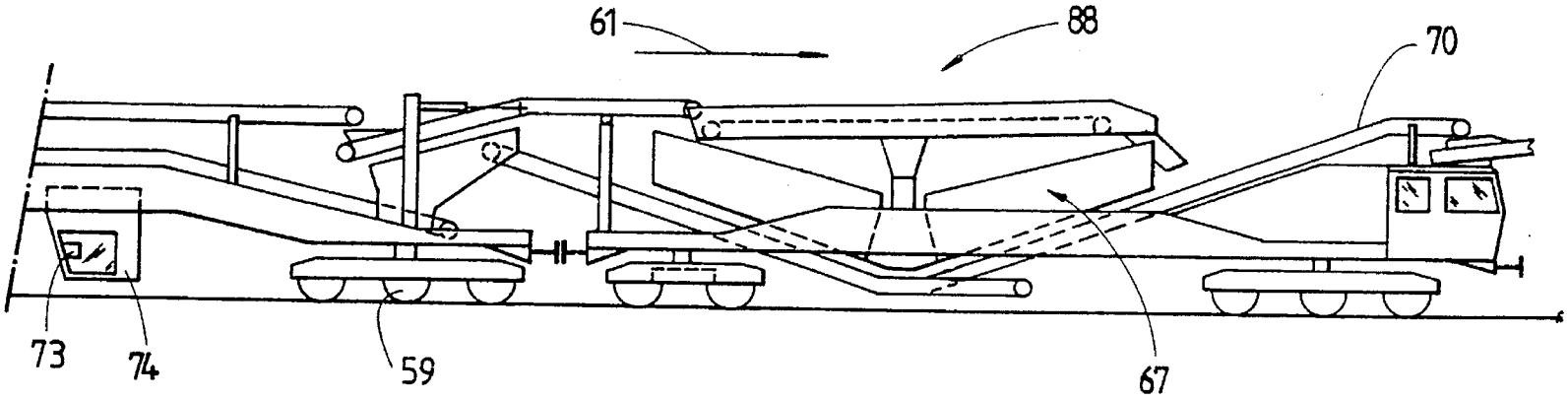
Figure 6:
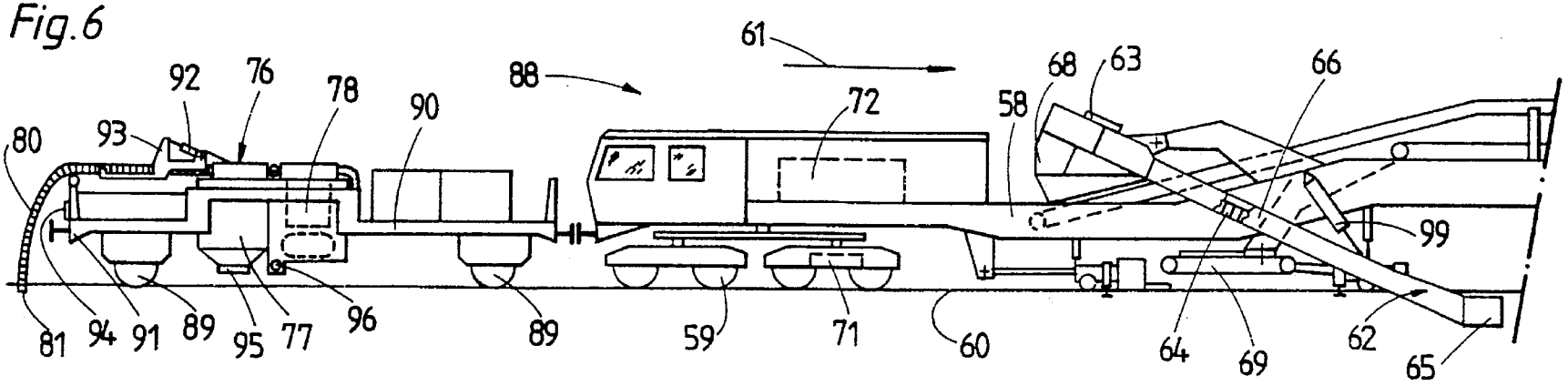

The parts of the cleaning machine 88 shown in FIGS. 5 and 6 which have the same reference numerals function are designated the same as in the description of FIG. 4 for the sake of simplicity. In this cleaning machine 88 the suction unit 76 is disposed on a trailer 90 which is supportable on track 60 by undercarriages 89 and which forms a part of the machine frame 58. The suction pipe 80 projects over a rear end 91 of trailer 90 and rests on a carrier frame 93 which is liftable and rotatable by drives 92. Like suction unit 76, said drives 92 are controllable with the help of a portable control device 94. The storage means 77 is provided at its lower end zone with a remote-controllable discharge opening 95, by means of which the sucked-in and stored crushed rock can be dropped as desired onto track 60. A further discharge opening of filter chamber 78 is provided with a swivellably arranged worm 96, by means of which the collected dirt can be ejected laterally next to the ballast bed of the track.

Said suction unit 76 is particularly suitable for producing a ditch in a layer of crushed rock by sucking off crushed rock so as to introduce the transvere chain member 65 below track 60. The crushed rock thus sucked in and stored in crushed-rock storage means 77 can be discharged through discharge opening 95 for filling the track 60 after ending the operation of cleaning machine 88 and after removing the transverse chain member 65 from the ballast bed of the track.

We claim:

1. A machine for treating a ballast bed underneath a track comprising sleepers, which comprises (a) a machine frame means extending in a longitudinal direction and supported on the track by undercarriages, (b) a suction unit mounted on the machine frame means, the suction unit comprising (1) a vertically and laterally adjustable suction pipe having a suction opening for aspirating crushed rock from the ballast bed, (c) a first drive means for vertically and laterally adjusting the suction pipe, (d) a clearing apparatus comprising (1) an endless, revolving clearing chain for removing crushed rock from the ballast bed underneath the track, the clearing chain being mounted on the machine frame means at a distance from the suction opening in the longitudinal direction, and (e) a second drive means operable independently from the first drive means for laterally adjusting the clearing chain.

2. The machine of claim 1, wherein the clearing apparatus comprises a clearing beam extending into the ballast bed perpendicularly to the longitudinal direction in an operating position, and two pulleys mounted on the clearing beam, the clearing chain being trained about the pulleys for revolving in a horizontal plane extending substantially parallel to the track.

3. The machine of claim 2, wherein one of the pulleys is located adjacent an end of a respective one of the sleepers in the operating position, and the suction pipe has attached thereto a suction hose having a suction opening adjacent the one pulley.

4. The machine of claim 1, wherein the machine frame means comprises a first machine frame having opposite ends and a second machine frame having opposite ends, the first machine frame supporting the suction unit, a carrier frame for the suction pipe, the suction pipe projecting beyond one of the first machine frame ends, and a conveyor belt unit at the opposite first machine frame end, and the second machine frame supporting the clearing apparatus, an operator's cab within view of the clearing apparatus, and another conveyor belt unit extending in the longitudinal direction and leading to one of the second machine frame ends, and further comprising a coupling connecting the one first machine frame end with an end of the second machine frame opposite the one end thereof.

5. The machine of claim 4, wherein the suction pipe has attached thereto a suction hose having a suction opening and an end opposite the suction opening, further comprising a coupling at the first machine frame end for detachably connecting the opposite suction hose end to the suction pipe.

6. The machine of claim 4, further comprising a coupling for detachably connecting a pipe section defining the suction opening with the suction pipe.

7. The machine of claim 1, wherein the machine frame means comprises a first and a second machine frame part, the machine frame parts being connected by an articulated joint and one of the undercarriages supporting the articulated joint on the track, the first machine frame part supporting the suction unit and a first conveyor belt unit extending partially below the suction units in the longitudinal direction to a discharge end projecting beyond an end of the first machine frame part opposite the articulated joint, and the second machine frame part supporting a vertically and laterally adjustable carrier frame for a suction pipe section defining the suction opening, the clearing apparatus and a second conveyor belt unit extending to an end of the second machine frame part opposite the articulated joint.

8. The machine of claim 1, wherein the clearing chain comprises a transverse course extending horizontally and perpendicularly to the longitudinal direction and two upwardly inclined longitudinal courses connected to the transverse course, the chain encompassing the track in an operating position wherein the horizontally extending course is situated below the track in the ballast bed, and comprising a screening installation arranged to receive crushed rocks excavated by the revolving chain and to clean the crushed rocks.

9. The machine of claim 8, wherein the clearing apparatus is mounted on the machine frame means between opposite ends thereof, and the suction pipe projects beyond one of the machine frame means ends.

10. The machine of claim 8, comprising a conveyor belt extending in the longitudinal direction and having a lower receiving end arranged below the suction unit and an elevated upper discharge end arranged above the screening installation.

11. The machine of claim 8, wherein the suction opening is positionable adjacently the transverse course.

* * * * *